US010787798B2

(12) United States Patent
Wenger

(10) Patent No.: US 10,787,798 B2
(45) Date of Patent: Sep. 29, 2020

(54) SHUT-OFF ELEMENT AND HYDRANT WITH SUCH A SHUT OFF ELEMENT

(71) Applicant: VONROLL INFRATEC (INVESTMENT) AG, Zug (CH)

(72) Inventor: Sascha Wenger, Oensingen (CH)

(73) Assignee: VONROLL INFRATEC (INVESTMENT) AG, Zug (CH)

( * ) Notice: Subject to any disclaimer, the term of this patent is extended or adjusted under 35 U.S.C. 154(b) by 21 days.

(21) Appl. No.: 16/307,052

(22) PCT Filed: Jun. 8, 2016

(86) PCT No.: PCT/EP2016/063080
§ 371 (c)(1),
(2) Date: Dec. 4, 2018

(87) PCT Pub. No.: WO2017/211414
PCT Pub. Date: Dec. 14, 2017

(65) Prior Publication Data

US 2019/0226184 A1 Jul. 25, 2019

(51) Int. Cl.
*E03B 9/02* (2006.01)
*E03B 9/04* (2006.01)

(52) U.S. Cl.
CPC ..... *E03B 9/02* (2013.01); *E03B 9/04* (2013.01); *Y10T 137/5415* (2015.04)

(58) Field of Classification Search
CPC ..... E03B 9/02; E03B 9/04; Y10T 137/5415
See application file for complete search history.

(56) References Cited

U.S. PATENT DOCUMENTS 2,980,125 A 4/1961 Grant et al.
3,104,554 A * 9/1963 Mueller ..... E03B 9/02 403/51
3,980,097 A * 9/1976 Ellis ..... E03B 9/14 137/283
4,072,163 A * 2/1978 Byrnes ..... E03B 9/06 137/296
4,127,142 A * 11/1978 Snider ..... E03B 9/04 137/285

(Continued)

FOREIGN PATENT DOCUMENTS

GB 817976 A 8/1959

OTHER PUBLICATIONS

International Search Report for corresponding PCT application No. PCT/EP2016/063080, dated Jun. 3, 2017.

*Primary Examiner* — Kevin R Barss
(74) *Attorney, Agent, or Firm* — Notaro, Michalos & Zaccaria P.C.

(57) ABSTRACT

A shut-off element of a hydrant with a hydrant axis. The shut-off element has a valve stem that is axially movable substantially along the hydrant axis, and a main valve body that can be brought into sealing contact with a sealing surface of the hydrant. The shut-off element has a damping system that is inserted between the main valve body and the valve stem or in a section of the valve stem or between an actuating element of the valve stem and the valve stem or in the actuating element itself, so that the main valve body is coupled to the valve stem axially dampened by the damping system along the hydrant axis.

17 Claims, 6 Drawing Sheets

(56) References Cited

U.S. PATENT DOCUMENTS

Figure 1B:
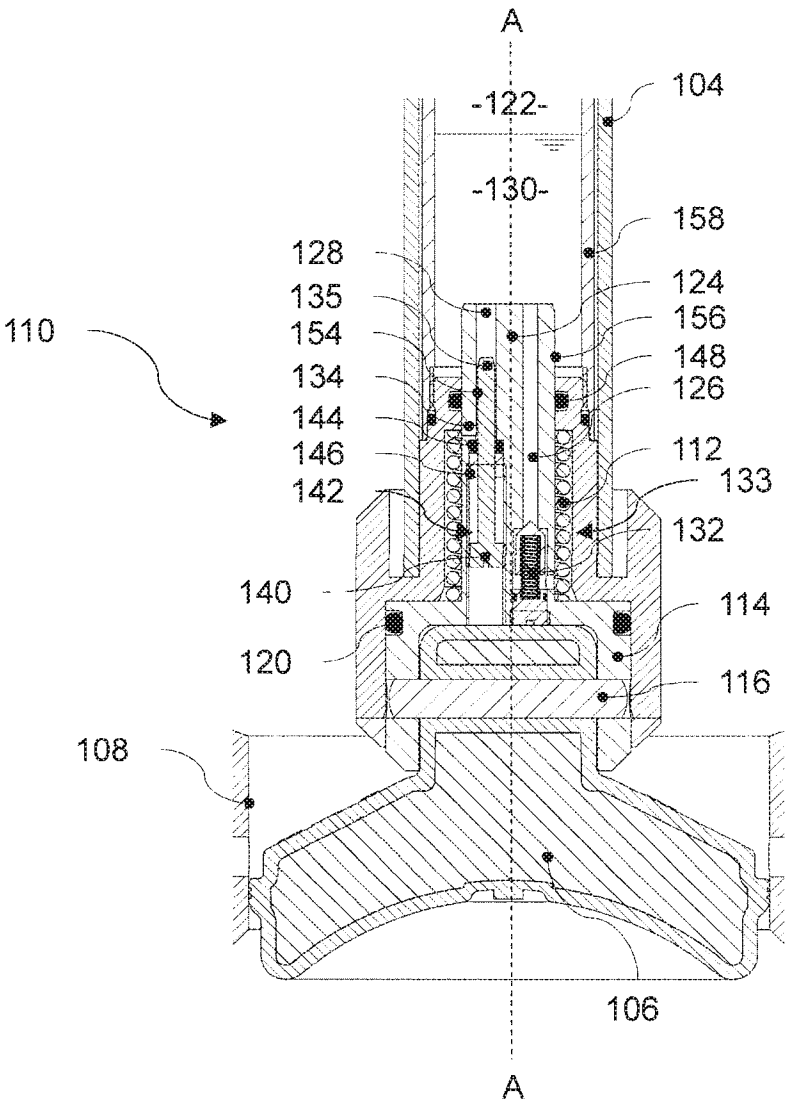

| | | | | |
|---|---|---|---|---|
| 4,562,962 | A * | 1/1986 | Hartman | B05B 1/3006 239/200 |
| 4,596,263 | A * | 6/1986 | Snider | E03B 9/04 137/493.3 |
| 5,609,179 | A * | 3/1997 | Knapp | E03B 9/04 137/68.11 |
| 2004/0187922 | A1 * | 9/2004 | Fleury, Jr. | E03B 9/02 137/71 |
| 2011/0168265 | A1 | 7/2011 | Cheney et al. | |

* cited by examiner

SHUT-OFF ELEMENT AND HYDRANT WITH SUCH A SHUT OFF ELEMENT

The present invention relates to a shut-off element and a hydrant. Hydrants are connected to a water distribution system and provide a faucet for extracting water, thus enabling the fire brigade as well as public and private users to extract water from the water distribution system. The network pressure in the water distribution system is typically about 6-9 bar. Hydrants comprise a riser with an interior and an exterior, wherein the water distribution system is usually connected via a bottom-side inlet pipe to the interior. The water is extracted via lateral connections from the interior.

For opening and closing hydrants, shut-off elements are known which can be arranged in the region or near the inlet pipe. Shut-off elements are, for example, hydrant main valves that comprise an axially adjustable main valve body, which can be closed by a sealing surface of the hydrant. Alternatively, the main valve body can be sealed off by a main valve seat removable from the hydrant. The main valve body is a sealing element, which seals with the sealing surface of the hydrant in a closed position and releases a connection between the bottom inlet pipe and the interior of the riser in an open position. The shut-off element further comprises a valve rod connected to the main valve body, via which valve rod the main valve body can be transferred from the closed position to the open position and vice versa. The valve rod is usually arranged axially in the riser of the hydrant and can be adjusted manually. Thereby, a manual rotation is transferred to an axial adjustment by means of an actuating element, for example a spindle, via which the valve rod and thus the main valve body are axially moved up and down.

A problem in the prior art is that pressure surges occur when closing the hydrant. The intensity of a pressure surge increases with increasing speed of the shut-off element. The pressure surge problem often leads to pipe breaks in the water distribution system, which has serious consequences. In addition to the problem of large water loss in the water distribution system and the decreasing water pressure, additional problems namely occur in relation to drinking water pollution as well as in relation to damage to terrain or roads. High pressure surges can also result in burst of a fire-fighting hose, for example. Due to the pressure surges there is also the danger that water from the hose can be pushed back into the water distribution system, whereby slop and/or extinguishing foam can get into the drinking water.

To solve the problem, it is known in the art that the shut-off element of the hydrant is to be closed slowly. For this purpose, it is proposed in the prior art to make the last turn to close the shut-off element slowly when closing the hydrant, since the largest change in the amount of water occurs when the valve is almost closed. A problem with this solution, however, is that this measure may fall into oblivion in an urgent firefighting, for example, or was not even known due to insufficient instructions of the operator. It is therefore an object of the present invention to propose a shut-off element which does not cause high pressure surges even when closing quickly. It is a further object of the present invention to provide a hydrant with such a shut-off element.

The aforementioned object is achieved by a shut-off element according to the independent claim 1 as well as a hydrant according to the independent claim 17. Further advantageous features emerge from the dependent claims.

According to the invention, the above-mentioned object is achieved by a shut-off element of a hydrant with a hydrant axis, wherein the shut-off element comprises a valve rod, which is axially movable substantially along the hydrant axis, and a main valve body, which can be brought into sealing engagement with a sealing surface of the hydrant. The shut-off element further comprises a damping system, which is arranged in-between the main valve body and the valve rod or in a portion of the valve rod or in-between an actuator of the valve rod and the valve rod or in the actuator itself such that the main valve body is coupled with the valve rod via the damping system axially damping along the hydrant axis.

As a result, a shut-off element is provided by a simple solution in which, regardless of the speed with which an operator closes the shut-off element via the actuating element, the main valve body of the shut-off element seals the hydrant with a nearly decoupled speed. The speed with which the main valve body comes into sealing engagement with the sealing surface of the hydrant when closing, is slowed down by the damping effect of the damping system, particularly from a position shortly before the closed position, whereby pressure surges are greatly reduced. In the open position, the main valve body is advanced a bit in relation to the valve rod. When transferring the main valve body to the closed position (upward movement), the main valve body follows this upward movement at a reduced speed, i. e. damped. With this reduced speed, the shut-off element is finally closed, this speed being adjustable (reducible) in such a way that high pressure surges are prevented. The damping system is arranged between the main valve body and the lower end of the valve rod or is between the actuator, for example a spindle, and the upper end of the valve rod. The damping system may alternatively be interposed in a portion of the valve rod. Further alternatively, the damping system can be interposed in the actuator itself. The actuator may be coupled at one end to the valve rod and configured to translate a torque applied at a further end of the actuator into an axial movement of the valve rod.

The actuator may include a spindle bearing, a spindle and a spindle nut.

Advantages of the present invention comprise:

There are no pressure surges in the hydrant—regardless of the speed with which the hydrant is closed.

The main valve body is retracted in the sealing surface of the hydrant at closing with a speed almost decoupled from the manual operation. Thus, the shut-off element is tracked only delayed also when closing rapidly in a manual fashion and thereby guaranteeing a slow shut-off or closing of the hydrant.

The structure of the inventive shut-off element is kept particularly simple. As a result, maintenance work is kept at a minimum and thus the costs can be kept low overall.

The damping system can be retrofitted. For this purpose, the damping system can be inserted subsequently between the lower end of the valve rod and the main valve body only, or between the actuating element and the upper end of the valve rod. Alternatively, the damping system can be subsequently interposed in a section of the valve rod. Furthermore alternatively, the damping system can be subsequently interposed in the actuating element itself. This allows a simple extension.

The damping system works with the pressure difference of the water in the inlet pipe and in the riser pipe. In the open position of the shut-off element, the clamping force of a compression spring of the damping system exceeds the difference in the forces in the opposite direction, generating the force difference by the respective pressure difference between the bottom and the top of the main valve body. This pressure spring acts on a piston section of the main valve body which is movably arranged in a cylinder space. Thus, the piston section of the main valve body is axially moved a bit out of the cylinder chamber of the damping system in the open position by means of the clamping force of the compression spring.

When closing the hydrant, with increasing approach of the main valve body to the sealing surface of the hydrant, the difference of forces steadily increases that are applied to the bottom and to the top of the main valve body, respectively. This force difference outweighs the resilience of the compression spring in the damping system so that it is compressed again. Thus, the piston section of the main valve body is retracted again into the cylinder chamber of the damping system. However, this movement is performed softly. For this purpose, a fluid must flow through a reducing element in the cylinder chamber, reducing the flow velocity of the fluid by the reducing element, with the result that the backflow of the fluid from the cylinder chamber into a designated fluid reservoir is slowed down or damped, respectively. This has the consequence that the main valve body only slowly retracts and thus only slowly reaches the closed position. In that the main valve body only very slowly retracts into the sealing surface of the hydrant, pressure surges are thus reduced advantageously.

The reducing element allows the adjustment of the flow rate at which the fluid is transferred from the cylinder chamber into the fluid reservoir. Thus, the flow rate can be advantageously adjusted. Because of this, the speed can be adjusted at which the main valve body is to be transferred into the closed position.

The reducing element may comprise a pin, which is inserted some distance into a return line so that the flow-through cross-sectional area of the return line is reduced. The fluid must flow through an annular space thus formed between the outer surface of the pin and the inner surface of the return line in the axial direction along the pin. The annular space or flow-through cross-sectional area of the return line can be adjusted by appropriate selection of the outside diameter of the pin and/or the inner diameter of the return line. Additionally, or alternatively, the length of the path along which the fluid flows through the annular space can be adjusted. For this purpose, the pin can be threaded deeper into the return line or retracted. The deeper the pin is retracted into the return line, the stronger the reflux of the fluid from the cylinder chamber into the fluid reservoir is inhibited, with the result that the main valve body is transferred into the closed position at a reduced speed.

Figure 1A:
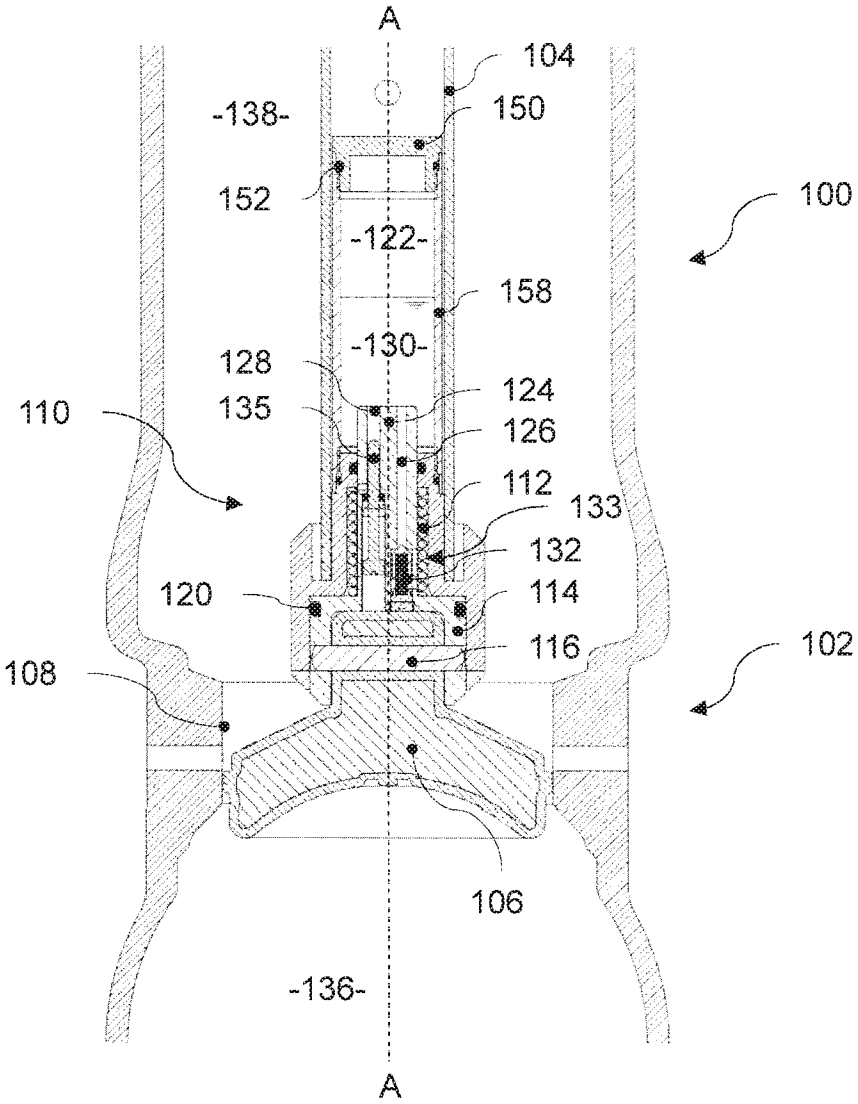
Figure 2B:
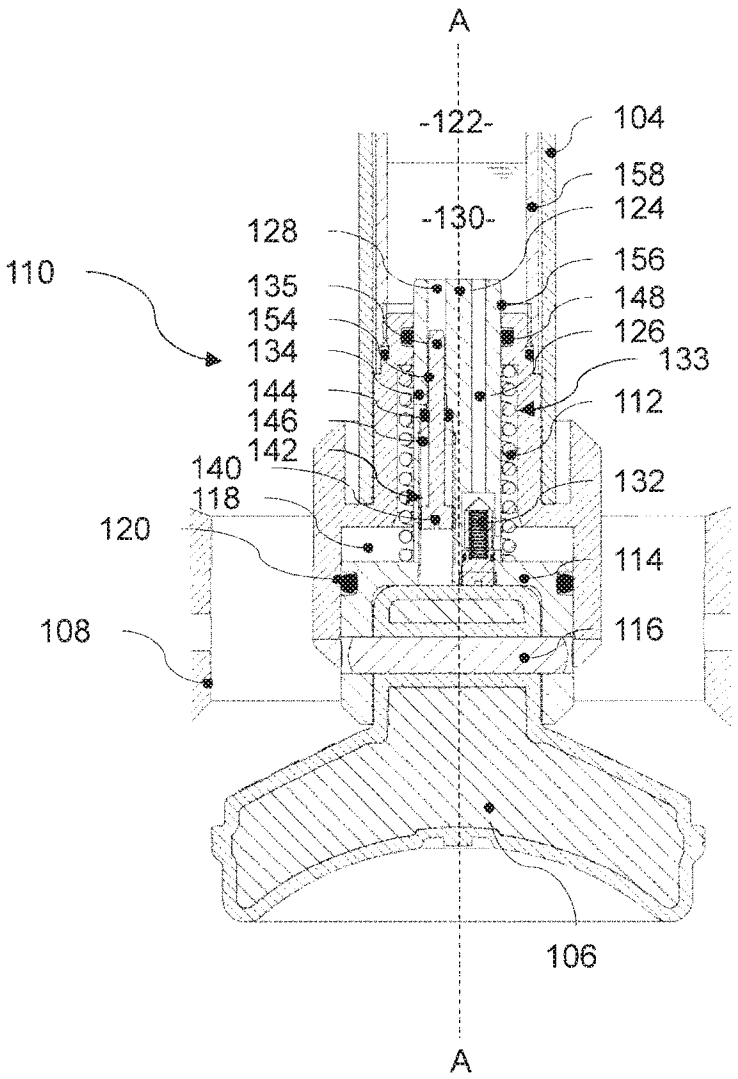
Figure 2A:
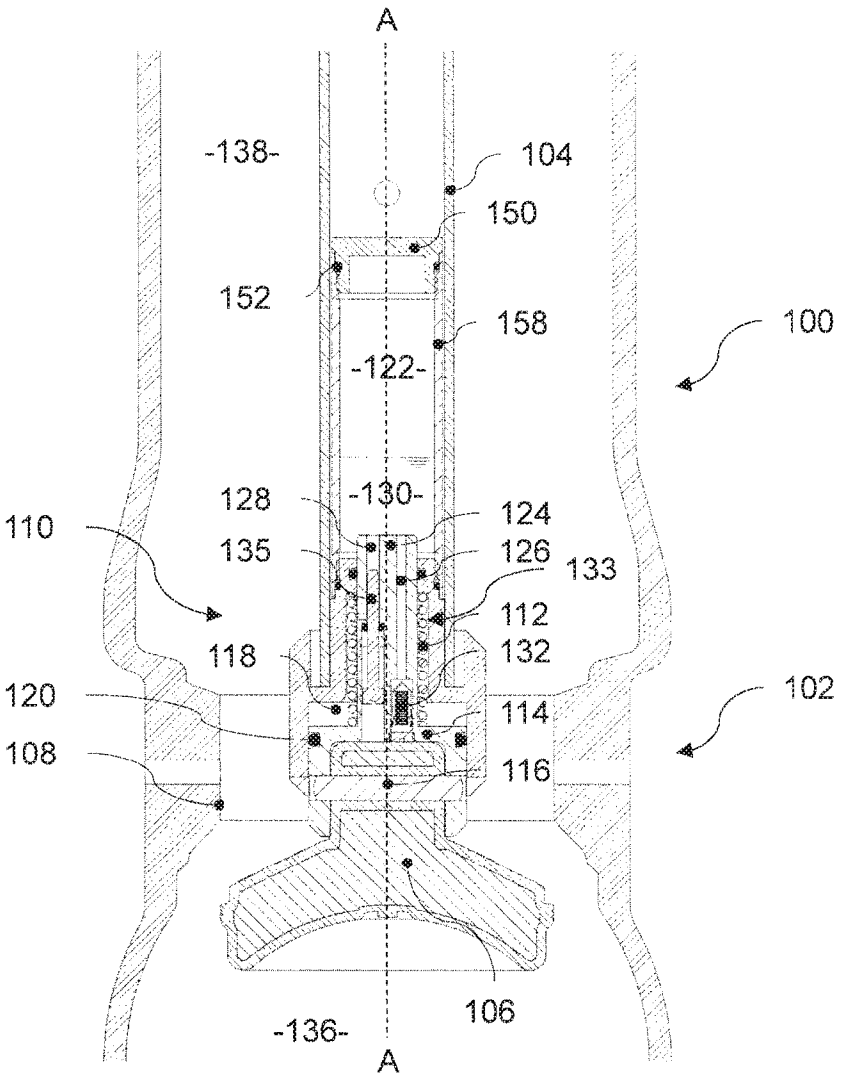
Figure 3B:
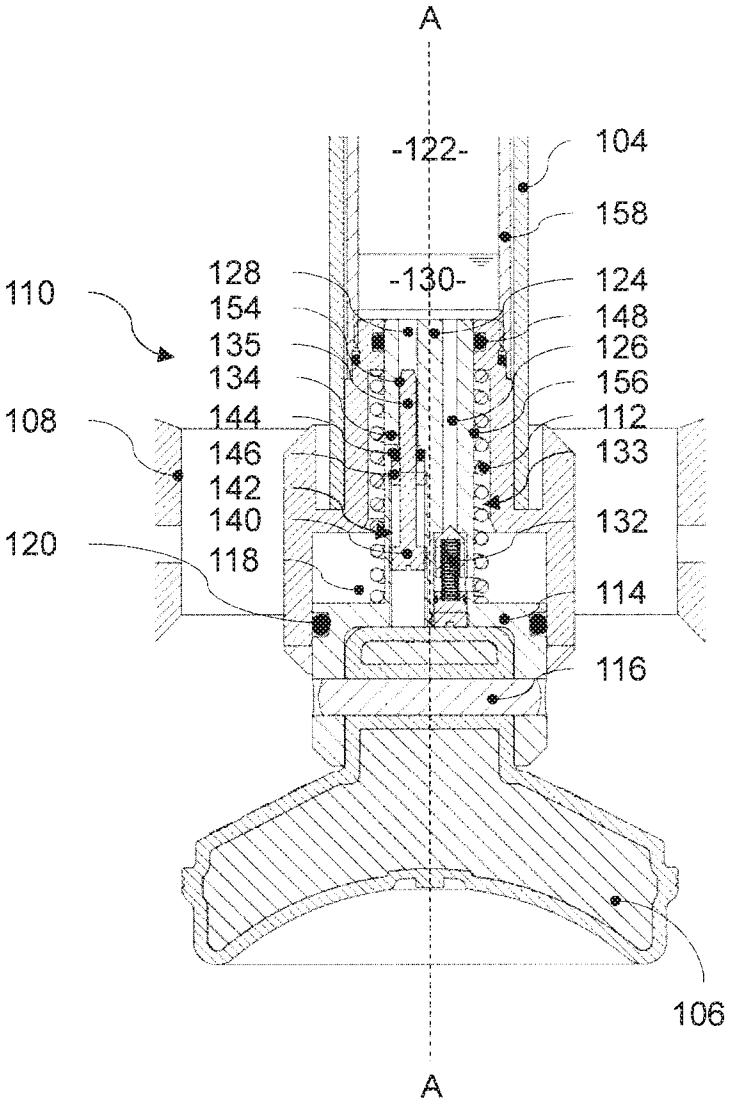
Figure 3A:
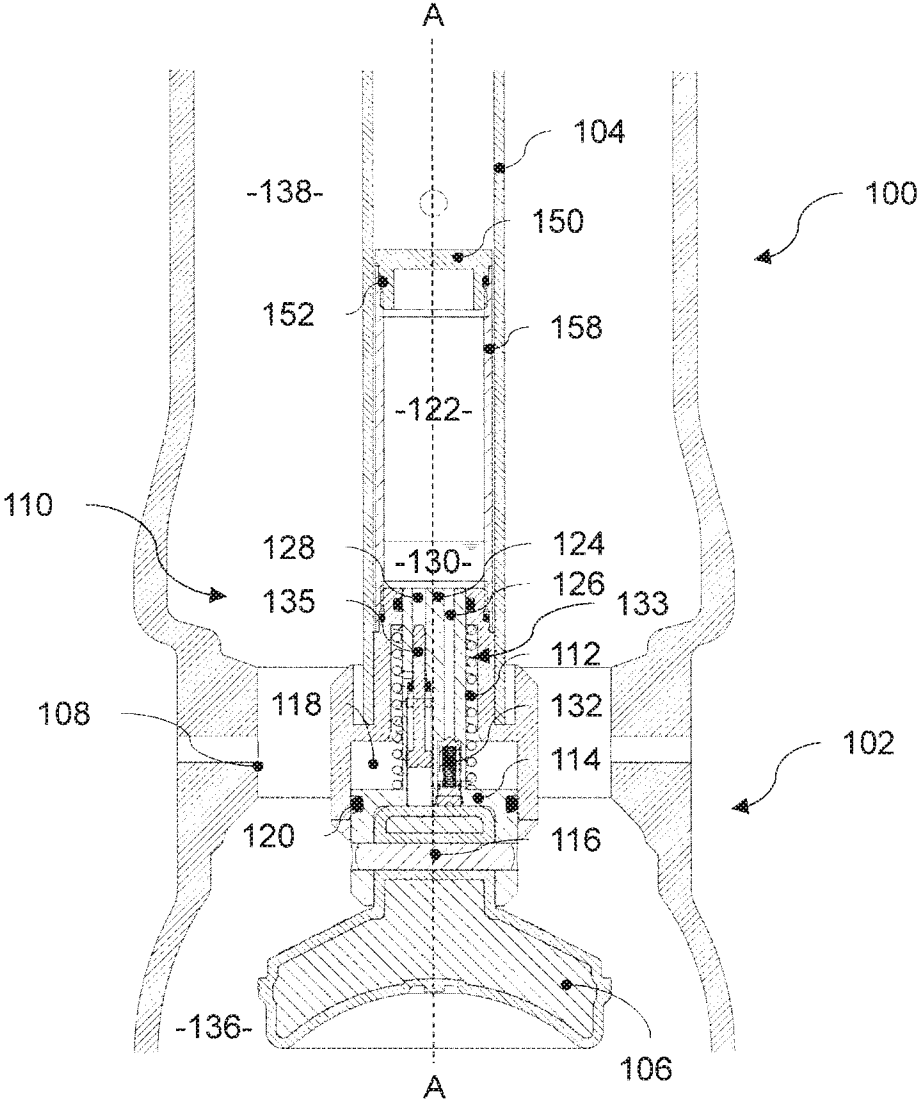
Figure 4B:
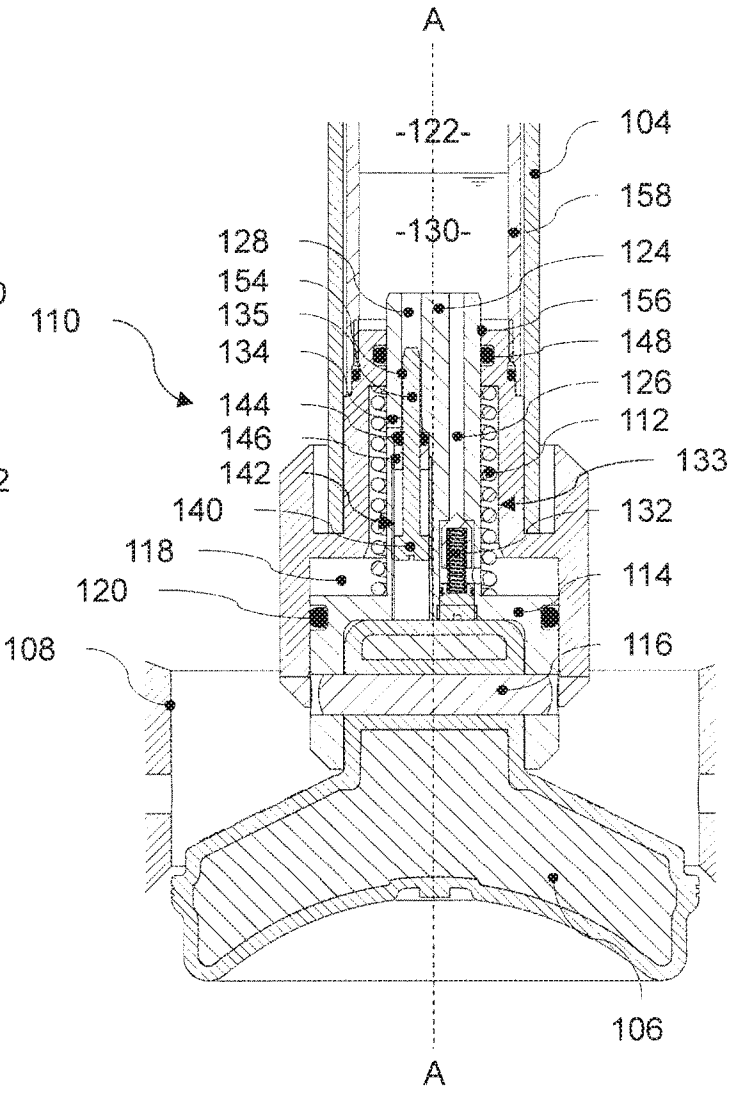
Figure 4A:
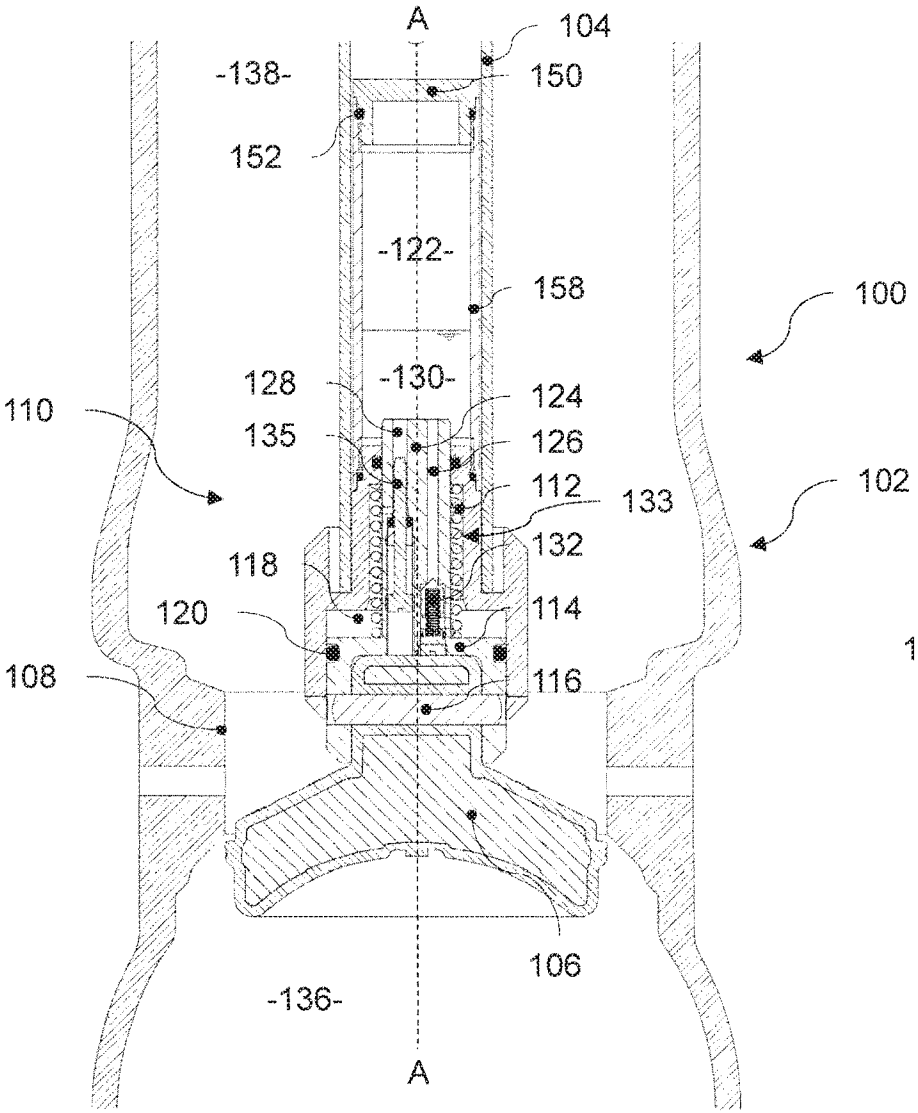

The shut-off element according to the invention will be explained in more detail based on exemplary embodiments and corresponding drawings which are not intended to limit the scope of the present invention. Showing:

FIGS. 1*a, b*: a sectional view of a portion of a shut-off element of a hydrant in a first, closed valve position and an enlargement thereof;

FIGS. 2*a, b*: a sectional view of the portion of the shut-off element in a second, partially open valve position and an enlargement thereof;

FIGS. 3*a, b*: a sectional view of the portion of the shut-off element in a third, fully open valve position and an enlargement thereof;

FIGS. 4*a, b*: a sectional view of the portion of the shut-off element in a fourth, almost closed valve position and an enlargement thereof; and FIGS. 5*a-d*: each show an enlargement view of the damping system in different positions of the shut-off element according to FIGS. 1*a* to 4*b*.

In the following, preferred embodiments of the shut-off element according to the invention and the hydrant are described in detail. The figures each show a sectional view of a hydrant 100 in different valve positions together with respective enlargements thereof. The hydrant 100 comprises a shut-off element 102, which comprises a valve rod 104 and a main valve body 106, which is brought into sealing engagement with a sealing surface 108 of the hydrant 100 according to FIGS. 1*a, b*. The shut-off element 102 further includes a damping system 110, which is interposed in the embodiment shown in the figures between the valve rod 104 and the main valve body 106. In other words, the main valve body 106 is coupled via the damping system 110 axially movable with the valve rod 104. Although not shown in the figures, the damping system can be arranged between the actuator element, for example a spindle, and the upper end of the valve rod 104, or interposed in a section of the valve rod. Further alternatively, the damping system can be interposed in the actuating element itself. The actuating element may be capable of converting a torque applied at one end of the actuating element in an axial movement of the valve rod. For this purpose, the actuating element may comprise a spindle bearing, a spindle and a spindle nut. The respective enlargement views of the figures, i.e. FIGS. 1*b*, 2*b*, 3*b* and 4*b*, show the damping system 110 in greater detail. The hydrant 100 has a hydrant axis A-A arranged vertically there. The hydrant axis A-A can also be arranged deviating from the vertical axis (not shown).

The damping system 110 is preferably designed as a spring-loaded damping system which allows a return or retraction of a piston section 114 of the main valve body 106 in the direction of the damping system 110 with reduced or damped movement. For this purpose, the damping system 110 comprises a compression spring 112 which is inserted biased at least between the damping system 110 and the piston section 114 of the main valve body 106. In the unloaded state, the compression spring 112 applies a compressive force between the damping system 110 and the piston section 114 of the main valve body 106. As a result, a compressive force is applied on the main valve body 106 for squeezing out or extending the piston section 114. As soon as a force predominates in the direction opposite to the direction of the pressure force from the pressure spring 112, the piston section 114 of the main valve body 106 is retracted, as explained in detail below.

The main valve body 106 comprises an upper piston section 114. In the embodiment shown in the figures, the piston section 114 is a separate component from the main valve body 106, which is connected to the upper side of the main valve body 106 via a fastening element 116, for example a pin connection 116. Although not shown, the piston section 114 may be integrally formed with the main valve body 106. In the embodiment shown, the piston section 114 is inserted in a cylinder chamber 118 of the damping system 110 in an axially movable manner. For sealing the cylinder chamber 118 relative to the outside, a first annular seal 120 is provided, which is preferably inserted into an annular groove of the piston section 114.

The damping system 110 further includes a fluid reservoir 122, which is received in an internal space of the valve rod 104 in the embodiment shown. The damping system 110 further includes a pipe body 124 in which an inflow conduit 126 and a return pipe 128 are disposed. The inflow pipe 126 permits an inflow of a fluid 130 stored in the fluid reservoir 122 into the cylinder chamber 118. In this case, the fluid 130 flows via the inflow pipe 126 and a check valve 132, which only allows the inflow of the fluid 130 into the cylinder chamber 118, but not its reverse flow in the reverse direction. This return flow is only possible via the return pipe 128. For this purpose, in the embodiment shown, the fluid 130 flows from the cylinder chamber 118 via an annular gap 133 which is formed between an inner surface of a housing portion of the damping system 110 and an outer surface of the pipe body 124, and then through an opening 134 or a bore in the pipe body 124 (or arranged therein) of the return pipe 128 and flows from there via the return pipe 128 into the fluid reservoir 122. The annular gap 133 also serves to receive the pressure spring 112.

To reduce the flow rate of the fluid 130 at reflux, a pin 135 is inserted at least in sections along the length of the return flow pipe 128. The pin 135 reduces the cross-sectional area of the return flow pipe 128 to only one annular space 154 between the outer surface of the pin 135 and the inner surface of the return pipe 128. Due to this reduced cross-sectional area, the fluid 130 flows back into the fluid reservoir 122 at a greatly reduced flow rate. Thus, the cylinder chamber 118 can escape only with delay when applying a strong force to the bottom of the main valve body 106. Since the fluid 130 is incompressible, the main valve body 106 is consequently retracted into the damping system 110 at a reduced speed (shock absorber principle). Hereby, the main valve body 106 advantageously closes only very slowly with the sealing surface 108 of the hydrant 100, and substantially independent or nearly decoupled from the speed at which the valve rod 104 is moved upward. Due to this reduced speed with which the hydrant 100 is closed, pressure surges are eliminated or significantly reduced in their amplitude when closing the hydrant 100.

In the following, the sequence between the opening and closing of the shut-off element 102 will be explained. FIGS. 1*a, b* show the shut-off element 102 in its closed position. In the closed position, the main valve body 106 is in sealing engagement with the sealing surface 108 of the hydrant 100, and the piston section 114 of the main valve body 106 is fully retracted into the damping system 110. FIGS. 2*a, b* show the shut-off element 102 in the course of opening. More specifically, the shut-off element 102 is shown in FIGS. 2*a, b* in a partially open position. In this open position, the pressurized water flows from an inlet pipe 136 of the hydrant 100 into a riser 138 of the hydrant 100. In contrast to the closed position of the shut-off element 102 shown in FIGS. 1*a, b*, the difference between the force applied to the underside of the main valve body 106 and the force applied to the top of the main valve body 106 is reduced. In this position, the pressure force or restoring force of the pressure spring 112 is predominant and forces the piston section 114 of the main valve body 106 a piece out of the cylinder chamber 118. By extending the main valve body 106, a negative pressure is generated in the cylinder chamber 118. Due to the negative pressure, the fluid 130 is sucked from the fluid reservoir 122 via the inflow pipe 126 and the check valve 132 into the cylinder chamber 118.

FIGS. 3*a, b* show the shut-off element 102 in a fully open position. In this position, the piston section 114 of the main valve body 106 is fully or maximally extended out of the cylinder chamber 118, and the cylinder chamber 118 is maximally filled with fluid. The fluid level in the fluid reservoir 122, however, is lowered compared to the previous positions.

FIGS. 4*a, b* illustrate the transition between the open position shown in FIGS. 3*a, b* and the close position of the shut-off element 102 shown in FIGS. 1*a, b*. In the FIGS. 4*a, b*, the shut-off element 102 is not yet completely closed. In this position, water flows under high pressure and with a particularly high speed from the inlet pipe 136 into the riser 138. Compared to the positions of the main valve body 106 shown in FIGS. 2*a, b* and 3*a, b*, the pressure which acts on the underside of the main valve body 106 is much higher than the pressure which acts on the top of the main valve body 106. In other words, the difference between the force applied to the underside of the main valve body 106 and the force applied to the top of the main valve body 106 is much greater than the force difference in those positions of the main valve body 106 shown in FIGS. 2*a, b* and 3*a, b*. As a result, the pressure spring 112 is compressed and the piston section 114 of the main valve body 106 moves back into the cylinder chamber 118 *a*.

As explained above, the fluid 130 located in the cylinder chamber 118 thereby flows back into the fluid reservoir 122 via the return pipe 128 at a reduced flow rate. Due to the damping explained above, the main valve body 106 closes at a reduced speed with the sealing surface 108 of the hydrant 100. Thus, pressure surges are advantageously avoided or at least greatly reduced in their amplitude. Thereby, an advantage is that the main valve body 106 retracts at a speed which is independent of the axial upward movement of the valve rod 104. In other words, the shut-off element 102 closes at a reduced speed even when the shut-off element 102 is closed at a speed which would have produced a very high amplitude pressure surge without the interposed damping system 110.

To adjust the flow rate at which the fluid 130 flows into the fluid chamber 122, the length at which the pin 135 retracts into the return pipe 128 may be changed. For this purpose, as illustrated in the embodiment, a pin head 140 of the pin 135 is provided with an external thread at its periphery, which external thread is threadedly engaged with an internal thread of an extension section 142 of the return pipe 128. The pin head 140 is provided with a slot into which the tip of a screwdriver (not shown) can be inserted. By turning the screwdriver, the pin 135 can thus be further retracted or extended into the return pipe 128.

The return pipe 128 and the extension section 142 of the return pipe 128 are sealed fluid-tight from each other by a second annular seal 144. Thus, no fluid 130 flows from the return pipe 128 into the extension section 142. The extension section 142 is sealed in a fluid-tight manner. There is preferably provided an annular guide 146 which also threadably engages the internal thread of the extension section 142. For this purpose, an outer circumference of the annular guide 146 is provided with an external thread. The annular guide 146 includes an axial bore through which the pin 135 is pushed through without clearance. As a result, the pin 135 is reliably guided axially. The annular guide 146 can be screwed into the extension section 142 until the annular guide 146 comes into abutment with the second annular seal 144. Alternatively, the annular guide 146 may be spaced from the second annular seal 144. Further, a third annular seal 148 is provided, which prevents a direct leakage of the fluid from the annular gap 133 via a possible existing gap between a portion of a housing 156 of the damping system 110 and the outer circumference of the pipe body 124. During extension and retraction of the piston section 114 of the main valve body 106, the outer circumference of the pipe body 124 thus sealingly glides along the third annular seal 148 in a sealing manner.

The fluid reservoir 122 is preferably closed by a cap 150, which fluid-tightly seals the fluid reservoir 122 via a fourth annular seal 152. Although not shown, the cap 150 can be sealingly attached, e.g. by welding, to a fluid reservoir wall 158 enclosing the fluid reservoir 122; in addition, a ventilation/venting can be provided, via which a pressure compensation can be established in an air space in the fluid reservoir 122, the air space preferably provided above the fluid 130, and the outside environment.

In the open position of the shut-off element 102, the pressure difference between the pressure acting on the underside of the main valve body 106 (a pressure from the inlet pipe) and the pressure acting on the top of the main valve body 106 (a pressure from the riser), is reduced. By the reduction of the difference of the forces resulting therethrough, which forces are applied to the underside and top of the main valve body 106 in each case, the pressure spring 112 of the damping system 110 can relax and thus further moved forward or pushed with the main valve body 106 in relation to the valve rod 104.

When closing the shut-off element 102, the above-mentioned pressure difference and the above-mentioned force difference increase and outweigh the clamping force of the pressure spring 112. In other words, the pressure spring 112 is compressed again. However, the damping system 110 allows the compression spring 112 to be damped or compressed at a reduced rate. In the above-mentioned valve adjustment, the fluid 130 located in the cylinder chamber 118 of the damping system 110 is transferred again into the fluid reservoir 122 at a reduced flow rate.

As shown in FIGS. 1*a* to 4*b*, the damping system 110 is interposed between the main valve body 106 and the valve rod 104. Alternatively, the damping system 110 may be interposed in a section of the valve rod 104. Still alternatively, the damping system 110 may be interposed between an actuator of the valve rod 104 and the valve rod 104. Further alternatively, the damping system can be interposed in the actuating element itself. It is essential here that the main valve body 106 is coupled axially damped to the valve rod 104 by means of the damping system 110 along the hydrant axis A-A.

Figure 5B:
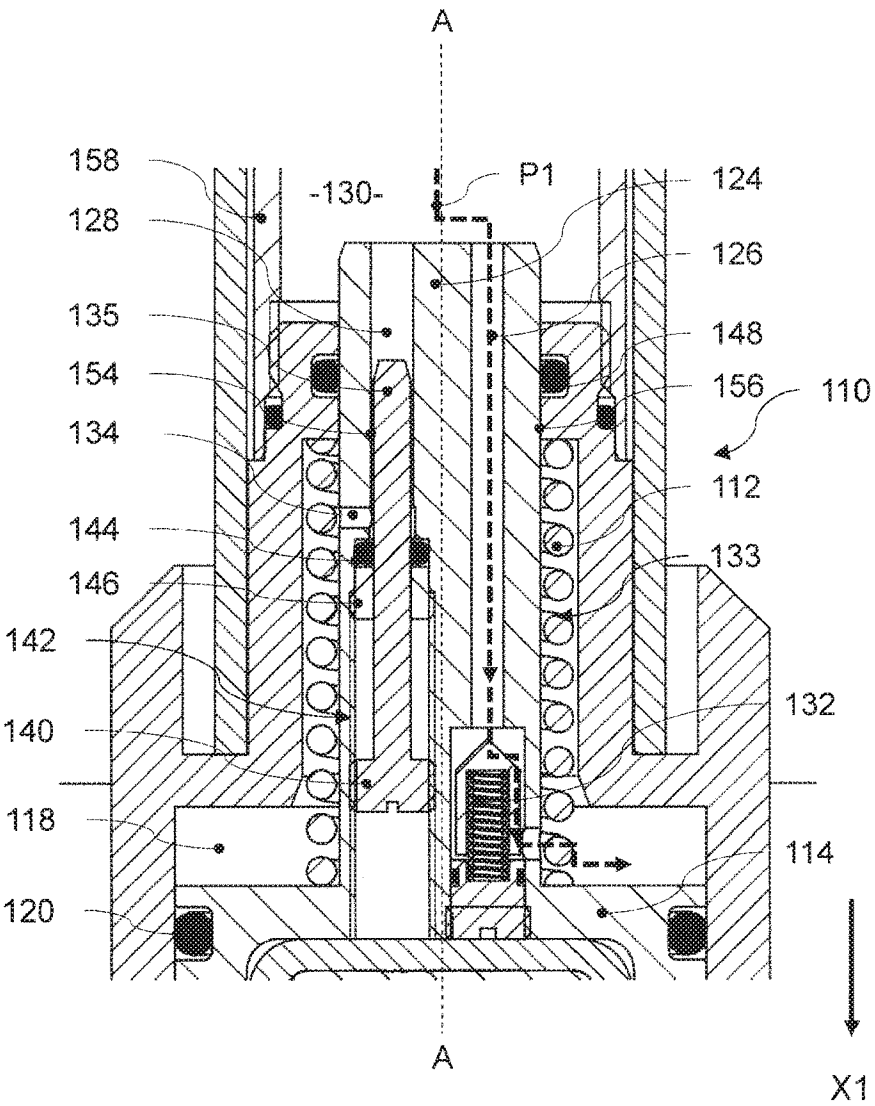
Figure 5A:
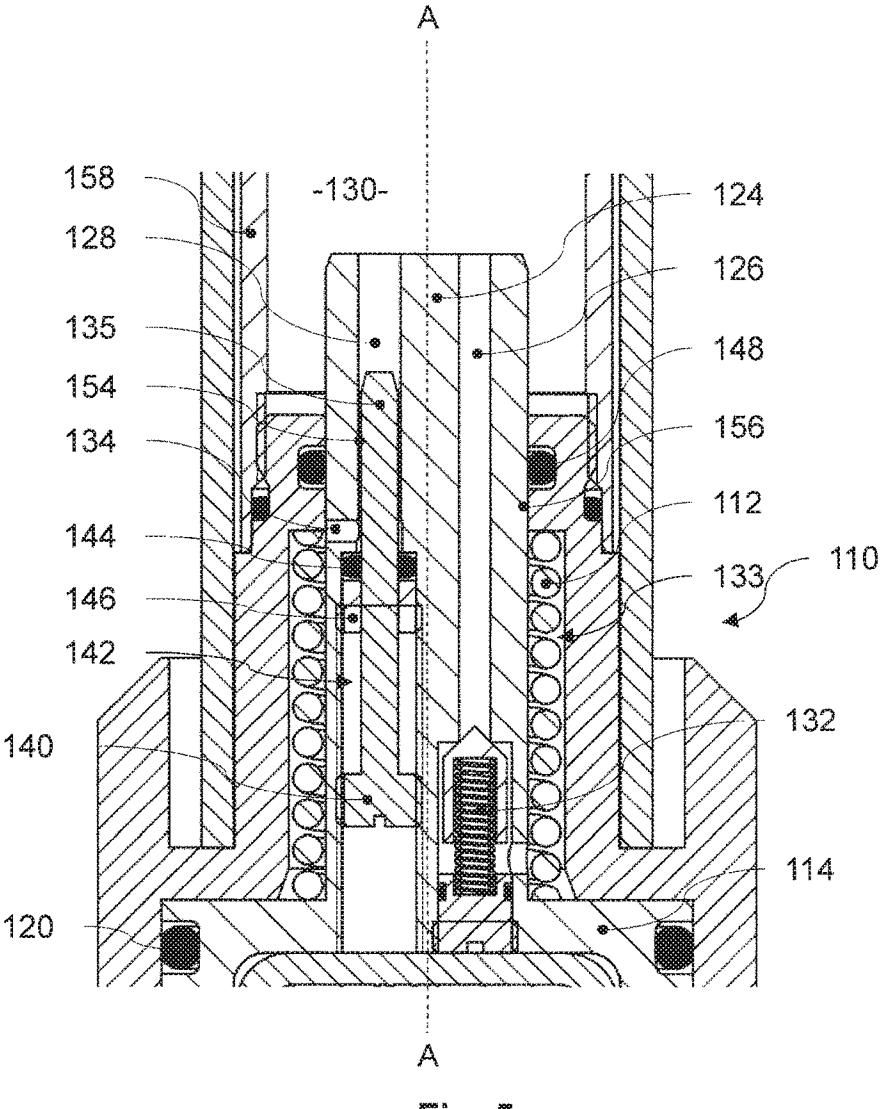
Figure 5D:
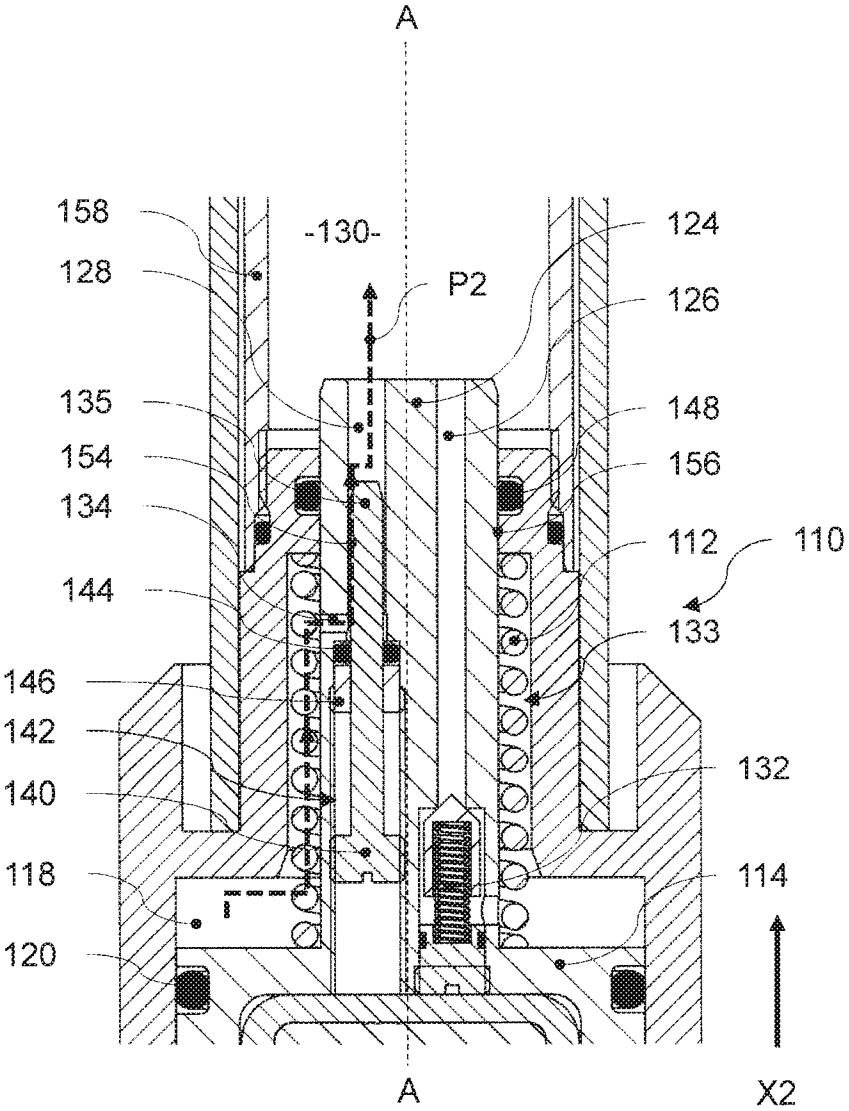
Figure 5C:
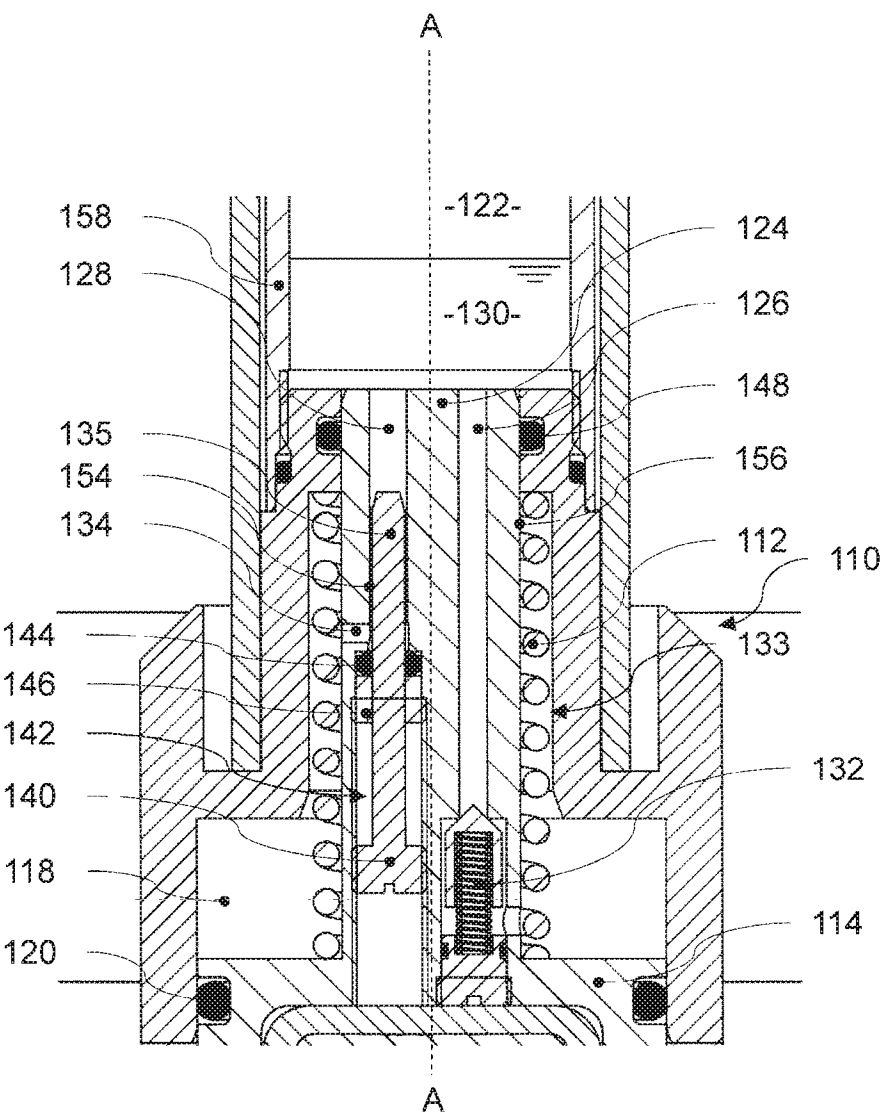

FIGS. 5*a-d* each show an enlargement view of the damping system 110 in different positions of the shut-off element (see FIGS. 1*a*-4*b*). Here, FIG. 5*a* shows the shut-off element in the closed position, FIG. 5*b* shows the shut-off element in a partially open position, i.e. in a transition between a close position and an open position, FIG. 5*c* shows the shut-off element in the open position, and FIG. 5*d* shows the shut-off element in the position shortly before the closed position. FIGS. 5*a-d* thus show processes in the damping system 110 in a sequence from the closed position via the open position and back to a position shortly before the closure of the shut-off element.

The damping system 110 of the shut-off element shown in FIG. 5*a* in the closed position is an enlargement view of the shut-off elements shown in FIGS. 1*a, b*. In the following explanation, therefore, reference is made to FIGS. 1*a, b*. In this position, the main valve body 106 is completely retracted and is in sealing engagement with the sealing surface of the hydrant.

The damping system 110 of the shut-off element shown in FIG. 5*b* in the partially open position is an enlargement of the shut-off element shown in FIGS. 2*a, b*. In the following explanation, reference is therefore made to FIGS. 2*a, b*. In this position, the main valve body 106 is pressurized from its bottom as well as its top. The pressure difference between the pressure at the bottom and the pressure at the top decreases with increasing downward movement of the main valve body 106. Therefore, the restoring force of the pressure spring 112 is stronger, whereby the piston section 114 of the main valve body 106 is extended a piece far out of the cylinder chamber 118, as indicated in FIG. 5*b* by an arrow along the extension direction X1. This creates a negative pressure in the cylinder chamber 118. By this negative pressure, fluid 130 is sucked from the fluid reservoir. The fluid 130 flows from the fluid reservoir via the inflow pipe 126 and the check valve 132 into the cylinder chamber 118. The check valve 132 allows only the inflow of the fluid 130 into the cylinder chamber 118, but not in the reverse direction. A first flow path in this direction is schematically indicated by P1 in FIG. 5*b*. The fluid 130 flows along this first flow path P1 substantially uninhibited, whereby the downward movement of the main valve body 106 is relatively quickly. Thus, when opening the hydrant at the outlet thereof, the full water pressure is applied without delay.

The damping system 110 of the shut-off element shown in FIG. 5*c* is an enlargement view of the shut-off element shown in FIGS. 3*a, b* in the fully open position. In this position, the piston section 114 of the main valve body 106 is maximally extended from the cylinder chamber 118. The cylinder chamber 118 is maximally filled with fluid 130.

FIG. 5*d* shows the damping system 110 of the shut-off element in a position in which the main valve body 106 is almost closed. This Fig. is an enlarged view of the shut-off element shown in FIGS. 4*a, b*. In the following explanation, reference is therefore made to FIGS. 4*a, b*. In the illustrated position of the main valve body 106, the afore-mentioned pressure difference increases with increasing upward movement of the main valve body 106 when closing the hydrant. The resulting force outweighs the pressure force of the pressure spring 112. Thereby, the main valve body 106 is moved upward, as shown by an arrow along the retraction direction X2, and the pressure spring 112 is compressed.

In order for the piston section 114 of the main valve body 106 to be able to move upwards in the cylinder chamber 118, the fluid 130 located in the cylinder chamber 118 must be expelled. For this purpose, a second flow path P2 is provided, which is separated from the first flow path P1. The fluid 130 flows back through the second flow path P2 from the cylinder chamber 118 back into the fluid reservoir. Thereby, the fluid flows over the annular gap 133, which is formed between an inner surface of a housing portion of the damping system 110 and an outer surface of the pipe body 124. This annular gap 133 advantageously serves simultaneously for receiving the pressure spring 112. From the annular gap 133, the fluid 130 then flows via the opening 134 into the return flow pipe 128. Fluid 130 flows upwardly through return pipe 128 into the fluid reservoir. The fluid 130 can only flow into the fluid reservoir via the second flow path P2, since the check valve 132 blocks a return flow via the first flow path P1.

In the return pipe 128, the pin 135 is at least partially inserted. In this case, the outside diameter of the pin 135 and the inside diameter of the return pipe 128 are dimensioned in relation to one another such that the predetermined annular space 154 or flow-through cross-sectional area is set between the pin 135 and the return pipe 128. The fluid 130 must thus force itself through this annular space 154 in the axial direction along the pin 134. As a result, the flow velocity of the fluid 130 is reduced, with the result that the fluid 130 can flow out of the cylinder chamber 118 only slowly. Thus, the piston section 114 of the main valve body 106 is retracted only slowly or damped in the cylinder chamber 118. As a result, the main valve body 106 is moved only slowly or damped upwards shortly before the closing position of the hydrant, whereby pressure surges are avoided or at least greatly dampened.

As described above, the speed at which the main valve body 106 moves upward can be set. For this purpose, the annular space 154 formed in the return pipe 128 can be set by appropriate selection of the outside diameter of the pin 135 and/or the inside diameter of the return pipe 128. In the embodiment shown in the figures, the distance at which the pin 135 enters the return pipe 128 is adjustable. Thus, the distance along which the fluid 130 must squeeze through the annular space 154 can be adjusted. With increasing length of the distance of the annular space 154, the return flow of the fluid 130 from the cylinder chamber 118 into the fluid reservoir is delayed. To set the distance of the annular space 154, the pin 135 is adjustable via a thread. Details of this are described in this description with reference to FIGS. 1*a*-4*d*. Thus, advantageously, the speed at which the hydrant completely closes can be adjusted, essentially independently of the speed by which the operator closes the hydrant. Thus, pressure surges are eliminated or at least greatly attenuated in their amplitude.

Like reference numerals refer to the same or corresponding features of the shut-off element and hydrant according to the invention, although is not pointed out in detail in each case and with respect to each figure.

LIST OF REFERENCE NUMBERS

| | |
|---|---|
| A-A | hydrant axis |
| P1 | first flow path |
| P2 | second flow path |
| X1 | extension direction |
| X2 | retraction |
| 100 | hydrant |
| 102 | shut-off element |
| 104 | valve rod |
| 106 | main valve body |
| 108 | sealing surface of the hydrant |
| 110 | damping system |
| 112 | pressure spring |
| 114 | piston section of the main valve body |
| 116 | fastening element |
| 118 | cylinder chamber |
| 120 | annular seal |
| 122 | fluid reservoir |
| 124 | pipe body |
| 126 | inflow pipe |
| 128 | return pipe |
| 130 | fluid |
| 132 | check valve |
| 133 | annular gap |
| 134 | opening |
| 135 | pin |
| 136 | inlet pipe |
| 138 | riser |
| 140 | pin head |
| 142 | extension section |
| 144 | second annular seal |
| 146 | annular guide |
| 148 | third annular seal |
| 150 | cap |
| 152 | fourth annular seal |
| 154 | annular space |
| 156 | housing of 110 |
| 158 | fluid storage wall |

The invention claimed is:

1. Shut-off element (102) of a hydrant (100) with a hydrant axis (A-A), wherein the shut-off element (102) comprises a valve rod (104), which is axially movable substantially along the hydrant axis (A-A), and a main valve body (106) which is adapted to engage in a sealing manner with a sealing surface (108) of the hydrant (100), wherein the shut-off element (102) further comprises a damping system (110) which is interposed between the main valve body (106) and the valve rod (104), wherein the main valve body (106) comprises a piston section (114) which is received axially movably in a cylinder chamber (118) enclosed in the damping system (110), such that the main valve body (106) is coupled to the valve rod (104) via the damping system (110) axially damping along the hydrant axis (A-A).

2. Shut-off element (102) according to claim 1, wherein the damping system (110) is designed as a spring-loaded damping system (110).

3. Shut-off element (102) according to claim 1, wherein the damping system (110) comprises a pressure spring (112) and a fluid reservoir (122) in which a fluid (130) is stored.

4. Shut-off element (102) according to claim 3, wherein the damping system (110) comprises an inflow pipe (126) having a check valve (132) and a return pipe (128), the inflow pipe (126) and the return pipe (128) communicating with the fluid reservoir (122) and with the cylinder chamber (118) such that the fluid (130) stored in the fluid reservoir (122) is conveyed via the inflow pipe (126) and the check valve (132) into the cylinder chamber (118) and via the return pipe (128) from the cylinder chamber (118) into the fluid reservoir (122).

5. Shut-off element (102) according to claim 4, wherein the check valve (132) is disposed in the inflow pipe (126) between the fluid reservoir (122) and the cylinder chamber (118).

6. Shut-off element (102) according to claim 4, wherein a flow-through cross-sectional area of the return pipe (128) is reducible at least in sections along the return pipe (128).

7. Shut-off element (102) according to claim 6, wherein the damping system (110) comprises a reducing element (135) which is at least partially inserted into the return pipe (128) such that the flow-through cross-sectional area of the return pipe (128) is reducible in this section.

8. Shut-off element (102) according to claim 7, wherein the reducing element comprises a pin (135) which is at least partially inserted into the return pipe (128).

9. Shut-off element (102) according to claim 8, wherein the outside diameter of the pin (135) and the inside diameter of the return pipe (128) are sized in relation to each other such that a predetermined annular chamber (154) is set between the pin (135) and the return pipe (128).

10. Shut-off device (102) according to claim 8, wherein the pin (135) is axially adjustable in relation to the return pipe (128).

11. Shut-off element (102) according to claim 8, wherein the pin (135) comprises at least an externally threaded section and the return pipe (128) comprises at least an internally threaded section, the externally threaded section and the internally threaded section being engaged threadingly.

12. Shut-off element (102) according to claim 3, wherein the pressure spring (112) is interposed between the damping system (110) and at least a section of the main valve body (106) and is adapted to apply a pressure force between the damping system (110) and the main valve body (106) for at least partially squeezing out the piston section (114) from the cylinder chamber (118).

13. Shut-off element (102) according to claim 3, wherein the fluid (130) comprises an oil having a predetermined viscosity.

14. Shut-off element (102) according to claim 1, wherein the actuator is coupled at one end to the valve rod (104) and is configured to transfer a torque applied at a further end of the actuator into axial movement of the valve rod (104).

15. Hydrant (100) comprising a riser (138), an inlet pipe (136) and a shut-off element (102) according to claim 1 for damping or eliminating pressure surges in the hydrant (100).

16. Hydrant (100) according to claim 15, further comprising a sealing surface (108), wherein the shut-off element (102) is adapted to move the main valve body from at least one open position relative to the sealing surface (108) to at least one closed position and vice versa, the shut-off element (102) being designed in the closed position such that the interior of the riser (138) is sealable relative to the inlet pipe (136).

17. Hydrant according to claim 15, wherein the damping element (110) is arranged in the actuator.

* * * * *